United States Patent [19]

Friedland

[11] Patent Number: 4,560,592

[45] Date of Patent: Dec. 24, 1985

[54] METHOD OF AND APPARATUS FOR DIP COATING

[75] Inventor: Anthony E. Friedland, Apple Valley, Minn.

[73] Assignee: Thermo King Corporation, Minneapolis, Minn.

[21] Appl. No.: 709,240

[22] Filed: Mar. 6, 1985

[51] Int. Cl.[4] ..... B05D 1/18

[52] U.S. Cl. ..... 427/430.1; 118/56; 118/416; 118/425; 118/500

[58] Field of Search ..... 118/56, 425, 416, 500; 427/430.1

[56] References Cited

U.S. PATENT DOCUMENTS

| | | | |
|---|---|---|---|
| 1,107,464 | 8/1914 | Trout . | |
| 2,658,008 | 11/1953 | Williams et al. . | |
| 2,831,454 | 4/1958 | Kearney . | |
| 3,341,353 | 9/1967 | Johnson . | |
| 3,472,203 | 10/1969 | Coleman | 118/425 |
| 3,792,683 | 2/1974 | Bragg . | |
| 4,013,807 | 3/1977 | Putney . | |
| 4,248,353 | 2/1981 | Budzich et al. | 118/425 |
| 4,268,206 | 5/1981 | Johnson . | |
| 4,331,230 | 5/1982 | Buckley . | |
| 4,402,765 | 9/1983 | Goto et al. . | |

*Primary Examiner*—Shrive P. Beck

*Attorney, Agent, or Firm*—E. C. Arenz

[57] ABSTRACT

A frame 50 having box section frame members 42 is connected by spider inserts 36 and 52 at the four corners of the frame which are linked through chains 34 to four frame handling devices 14 which include a pneumatic cylinder 16 operated to lower the frame to the horizontal 50B position in the tank with the cylinders 16 then being operated to tilt the frame in the tank about three different axes (FIGS. 5–7) to insure a complete coating of all the members of the frame and the purging of air from all entrapping cavities and/or corners of the frame.

4 Claims, 7 Drawing Figures

METHOD OF AND APPARATUS FOR DIP COATING

BACKGROUND OF THE INVENTION

This invention pertains to the art of applying a coating such as paint or the like to an object by dipping the object in an immersion tank.

This invention arose in connection with attempting to develop a method of properly protecting a large integral part assembly, such as the main frame of a transport refrigeration unit, that has previously had only marginal corrosion resistance and thus a potential for premature component failure due to internal corrosion. The part assembly which will be used as an example in explaining the invention is a relatively heavy, transport refrigeration unit frame, which consists of mild steel structural tubing weldment that for cosmetic and cost reasons is mild steel material. The assembly should be properly protected inside and out with a process that is of reasonable cost.

The past method of applying a paint film to the frames constructed by applicant's assignee was by spray painting. Known methods of spray painting result in only marginally complete paint film coverage to a frame that has a complex internal configuration with hollow cavity sections and/or corner spaces which should be protected due to the frame structural design and the potential for corrosion if surfaces are not properly protected. Spray painting, whether conventional, airless, airless electrostatic, electrostatic or powder, all have the same problem; particularly, that spray painting of complex internal surfaces is very time consuming if properly done, thereby resulting in high labor content. Depending upon the product volume, high labor content not only has a great effect on the cost of the product, but an impact on production capacity as well.

Therefore, the aim of this invention is to provide a method of and apparatus for dip coating or painting a transport refrigeration frame in a way that the coating substantially completely covers all surfaces of the frame, and voids from air entrapment in corner spaces and hollow sections is eliminated.

SUMMARY OF THE INVENTION

The essence of the invention in its method form is to support the object to be coated in an immersion tank at at least three points around or adjacent the periphery of the object, and then successively changing the relatively elevation of at least one of the points relative to the elevation of at least two other of the points in a sequence in which all of the said points are successively so relatively elevated so that the object will have been relatively tilted about at least three axes through said object to insure a complete coating of all of the members of the object and the purging of air from all entrapping cavities and/or corners. The invention also comprehends providing the apparatus for carrying out such a method.

DRAWING DESCRIPTION

DESCRIPTION OF THE PREFERRED EMBODIMENT

Figure 1:
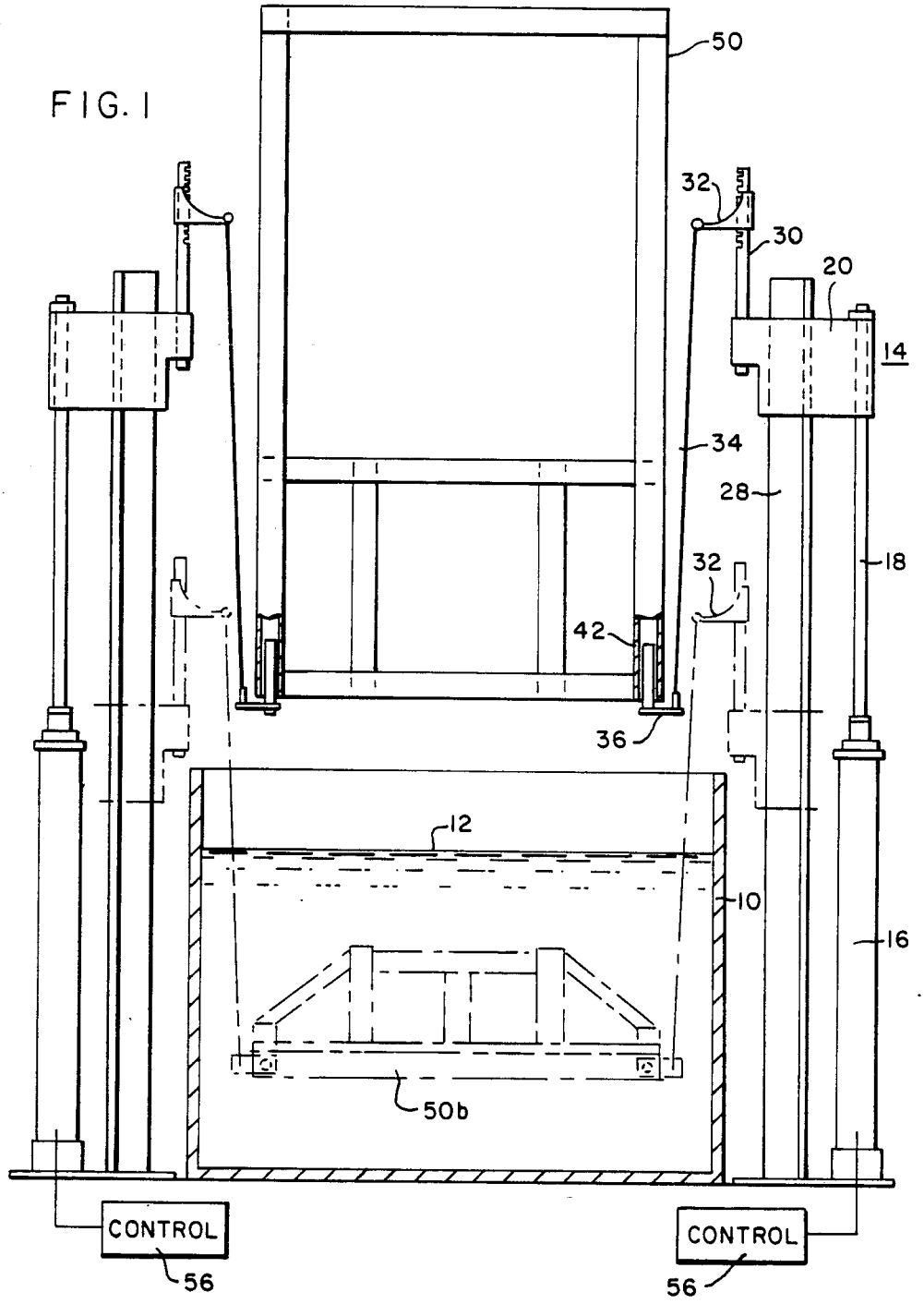
FIG. 1 is a partly schematic end elevation view of an arrangement for carrying out the invention.
Figure 2:
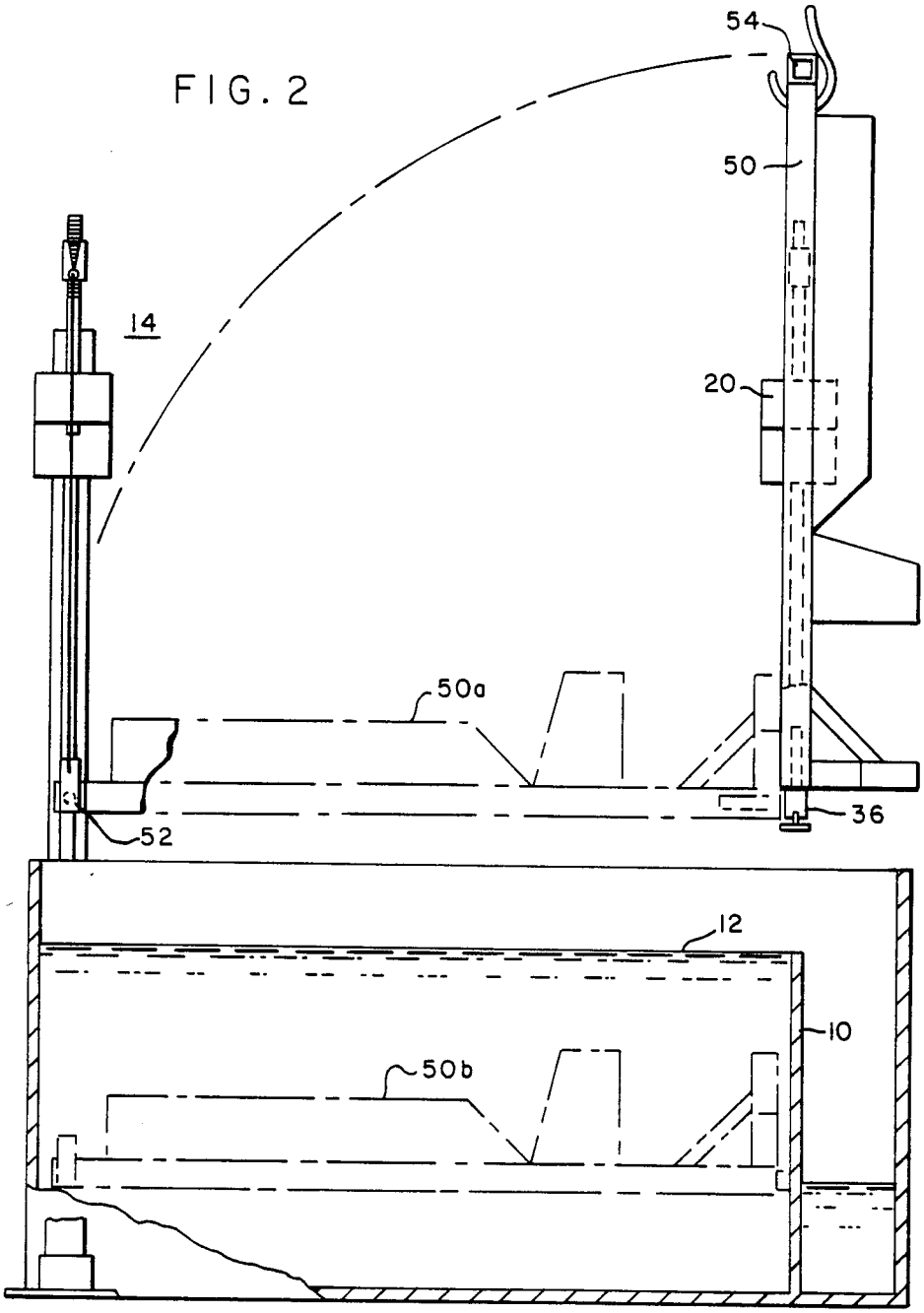
FIG. 2 is a partly broken and somewhat simplified side elevation of the arrangement.

Referring to FIGS. 1 and 2, a rectangular immersion or dip tank 10 is filled with a paint or coating fluid to a level 12.

At each of four locations around the perimeter of the tank 10, a frame handling device generally designated 14 is located. Since each of the devices 14 is basically the same as the others, only one will be described in some detail. The device includes a pneumatic cylinder 16 with a vertically extensible-retractable rod 18 which has a carriage 20 attached to the upper end of the rod.

Figure 3:
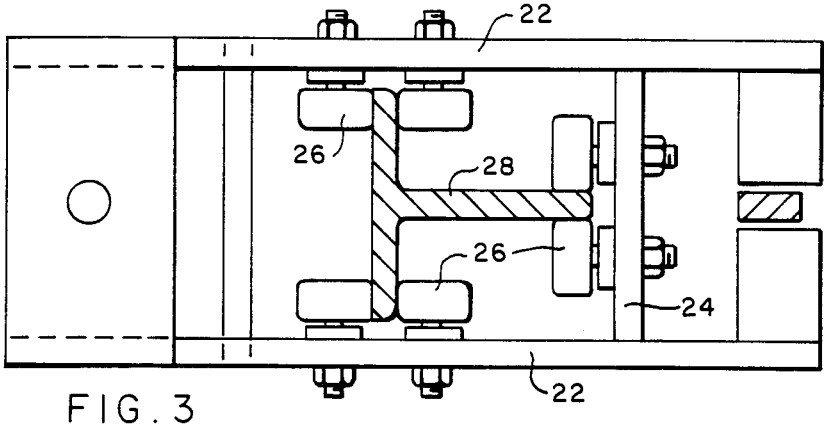
FIG. 3 is a top view of a vertically movable carriage for carrying out the invention.

The carriage 20, as shown in some detail in FIG. 3, includes a pair of spaced-apart plates 22 and a transverse plate 24, each carrying rollers 26 strategically located as shown in FIG. 3 to stabilize the carriage, which is vertically movable relative to the T-shaped guide 28.

Figure 4:
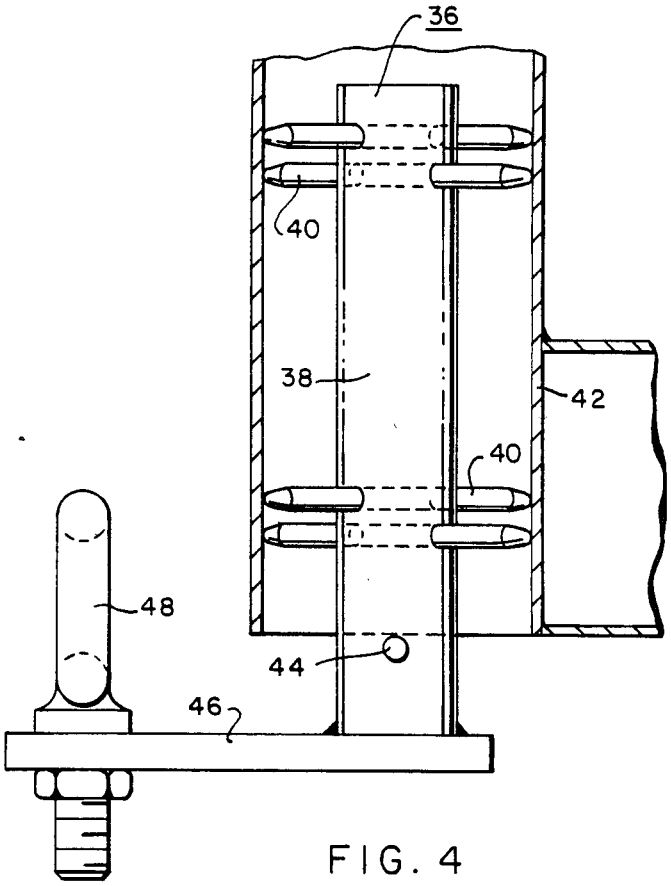
FIG. 4 is a view of an insertion lifting spider used in carrying out the invention.

The part of the carriage closest to the tank carries a vertical bar 30 which has mounted thereon an adjustable jaw bar clamp 32. The end of the clamp 32 has attached thereto a flexible chain or link 34 which has its other end attached to a lift spider 36, one of which is shown in some detail in FIG. 4. The lift spider includes a hollow tube 38 through which projects four cone-end dowels 40 and disposed relative to the particular tube to provide point contact of the pointed ends in the internal corners of the rectangular frame member 42. The spider insert also has a positive stop as at 44 to control the depth to which the spider insert projects into the frame section 42. The spider insert also includes a transverse bracket 46 welded to the tube 38 and carrying an eye bolt 48 to which the link 34 is attached.

The way the invention is carried out with the apparatus shown in FIGS. 1 and 2 is as follows. The frame, generally designated 50 as a whole, is made up of a number of members including perimeter members which are box sections as illustrated at 42. The frame is brought to the dip tank work station in a vertical disposition on a monorail (not shown) or the like and is lowered to the solid line position shown in FIG. 2 by a pneumatic lift device (also not shown), this lowering operation permitting the lower frame spider inserts 36 to be inserted into the open-ended bottoms of the box sections 42. The lift device is then used to lower the top end of the frame, pivoting about the lower end lift devices 36, to the horizontal position above the tank as shown in the phantom line outline of the frame 50A in FIG. 2. The upper frame end spider inserts 52 are at this point inserted in the open ends of the frame top box section 54. These upper frame spiders are of basically the same construction as the lower spiders with respect to the part which is inserted into the box section, the differences between the two spider inserts basically being the construction of the outer end of the insert which is attached to the length 34. The station electric lift is then disconnected from the upper box section 54 so that the frame is supported at its four corners by the four frame handling devices 14. The four pneumatic cylinders are then operated as by a control 56 shown schematically in FIG. 1, to lower the frame to the phantom line position 50B, at which point the frame is totally immersed and the clamp bars 32 have descended to their phantom line positions.

Figure 5:
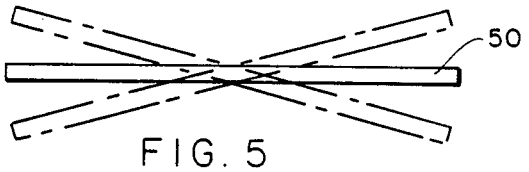
FIG. 5 is a schematic illustration of the movement of the frame about one axis for end-to-end tilting.
Figure 6:
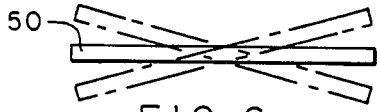
FIG. 6 is a schematic illustration of side-to-side tilting of the frame about another axis.
Figure 7:
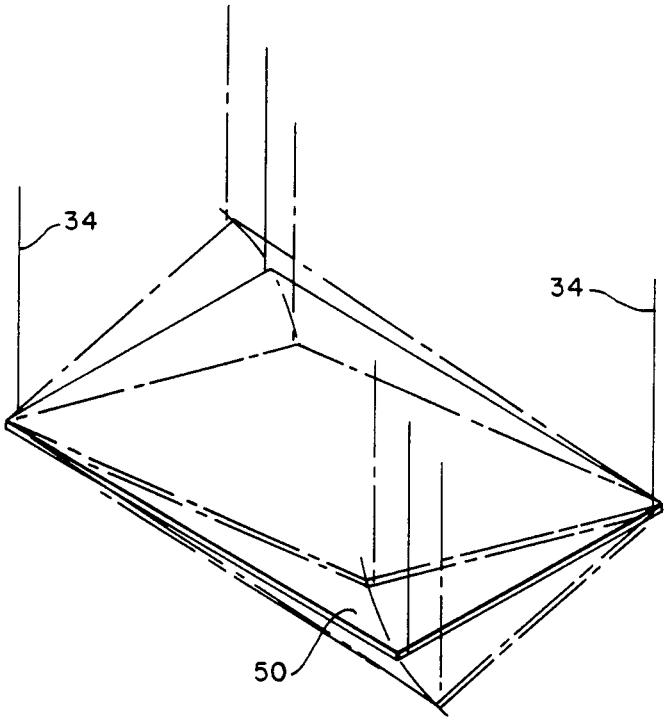
FIG. 7 is a schematic illustration of frame tilting about a diagonal axis extending from one corner to an opposite corner of the frame.

With the frame 50 immersed in the bath it is then tilted about at least three separate axes which can perhaps be best perceived in connection with FIGS. 5–7. The frame 50 is schematically illustrated as being planar in these figures and in FIG. 5 the two corners at one end of the frame are elevated and then depressed relative to the two corners at the opposite end of the frame. In FIG. 6 the frame 50 is shown as having two corners on one side of the frame elevated and then depressed relative to the two corners on the opposite side of the frame. In FIG. 7, one corner is elevated and then depressed relative to its diagonally opposite corner. In this case the axis about which the tilting occurs is a diagonal axis. In what is currently considered to be the preferred embodiment, the method also includes tilting the opposite diagonal corners about the other diagonal axis of the frame, but this tilting would present the same view as in FIG. 7.

The sequence in which the tilting about the various axes occurs is not important in carrying out the invention, the sequence described being simply an example. By carrying out the method as described, the paint or coating covers all surfaces of the members making up the frame including the hollow interiors of the box sections and various corner spaces formed by members of the frame oriented in different planes. After the frame has been coated in the bath as described, it is then raised up out of the bath back to the full horizontal position 50A (FIG. 2) and allowed to drain for a short time, such as approximately a minute. The top portion 54 of the frame is then manually reconnected to the monorail lift, the frame top end spider inserts 52 removed and the frame is pivoted from its **50*a* horizontal position to its vertical position and then the bottom frame spider inserts 36** are removed and the frame is permitted to continue draining for several minutes before being moved by the monorail to another station (not shown) before moving into an oven, also not shown.

While the invention has been described in connection with a particular character of object to be coated and in which the method has particular applicability because of the numerous box sections of which the frame is fabricated, it should be apparent that the method could also be applicable to various other objects in which the problem of air entrapment in cavities and corners would provide a problem in connection with simply dipping the object into a tank.

I claim:

1. The method of dip coating in a coating immersion tank a frame-like object having hollow cavity sections and/or corner spaces formed by members of the frame oriented in different planes, comprising:

supporting said object by attaching the object at points spaced around its periphery at at least three locations above said tank with the major dimension of said object in a horizontal disposition;

lowering said object into said tank to a level at which said object is totally immersed;

successively changing the relative elevation of at least one said point relative to the elevation of at least two other said points in a sequence in which all said points are successively so relatively elevated so that the object will have been relatively tilted about at least three different axes through said object to insure a complete coating of all said members and the movement thereof and/or purging of air from all entrapping cavities and/or corners; and then, raising said object from said tank.

2. The method of claim 1 wherein said frame-like object has at least three corners: and supporting said object at said at least three corners, and carrying out the others of the steps of claim 1 while the object is supported at said corners.

3. The method of claim 2 wherein said frame-like object is a frame which is rectangular in its main dimension outline and has outline frame members which are of hollow box-shape in section with at least one open end at each corner of said frame: and inserting a spider in each said open end to provide a supporting connection at each corner before lowering said frame.

4. Apparatus for dip coating, in a coating immersion tank, a frame-like object having hollow cavity sections and/or corner spaces formed by members of the frame oriented in different planes, comprising:

means for supporting said object by attaching said object to points spaced around its periphery at at least three locations, above said tank, with the major dimension of said object in a horizontal disposition;

means for lowering said object into said tank to a level at which said object is totally immersed;

means for successively changing the relative elevation of at least one said point relative to the elevation of at least two others of said points in a sequence in which all said points are successively so relatively elevated so that the object will have been relatively tilted about at least three axes through said object to insure a complete coating of all said members and the purging of air from all entrapping cavities and/or corners; and means for raising said object from said tank.

* * * * *